US007141941B2

(12) United States Patent
Lyle, Jr. et al.

(10) Patent No.: US 7,141,941 B2
(45) Date of Patent: Nov. 28, 2006

(54) STAGGERING SWITCHING SIGNALS FOR MULTIPLE COLD CATHODE FLUORESCENT LAMP BACKLIGHTING SYSTEM TO REDUCE ELECTROMAGNETIC INTERFERENCE

(75) Inventors: Robert L. Lyle, Jr., Raleigh, NC (US); Lawrence George Pearce, Palm Bay, FL (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

(21) Appl. No.: 10/968,480
(22) Filed: Oct. 19, 2004

(65) Prior Publication Data

US 2005/0242752 A1 Nov. 3, 2005

Related U.S. Application Data

(60) Provisional application No. 60/565,955, filed on Apr. 28, 2004.

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl. ..... 315/312; 315/209 T; 315/307

(58) Field of Classification Search ..... 315/141, 315/142, 172, 174, 175, 176, 209 R, 212, 315/213, 219, 220, 224, 209 T, 242, 243, 315/255, 257, 291, 307, 312, DIG. 4, DIG. 5, 315/DIG. 7

See application file for complete search history.

(56) References Cited

U.S. PATENT DOCUMENTS

| | | | | |
|---|---|---|---|---|
| 5,055,746 | A * | 10/1991 | Hu et al. | 315/291 |
| 5,621,281 | A * | 4/1997 | Kawabata et al. | 315/311 |
| 6,459,938 | B1 * | 10/2002 | Ito et al. | 700/9 |
| 6,501,234 | B1 * | 12/2002 | Lin et al. | 315/307 |
| 6,570,344 | B1 * | 5/2003 | Lin | 315/224 |
| 6,707,264 | B1 * | 3/2004 | Lin et al. | 315/307 |
| 6,778,415 | B1 * | 8/2004 | Lin | 363/71 |
| 6,963,179 | B1 * | 11/2005 | Yu et al. | 315/318 |
| 2004/0178781 | A1 * | 9/2004 | Lin | 323/282 |
| 2004/0183469 | A1 * | 9/2004 | Lin et al. | 315/247 |

* cited by examiner

*Primary Examiner*—Don Wong
*Assistant Examiner*—Marie Antoinette Cabucos
(74) *Attorney, Agent, or Firm*—Fogg and Associates LLC

(57) ABSTRACT

In order to minimize switching-induced electromagnetic interference in a power supply switching circuit of the type used to control the AC power for multiple high voltage devices, such as cold cathode fluorescent lamps employed for backlighting a large scale liquid crystal display, the gating signals that are used to switch lamp-driving inverter circuits ON and OFF are staggered, or slightly offset in time, so that no two switching devices will be switched at the same time. By slightly offset in time is meant that the time differential between any pair of switching signals is relatively small compared to the period of the switching signal frequency. This has the effect of spreading out and thereby diminishing the magnitude of the spectral content of both capacitively and inductively coupled transients that are produced at switching times of the inverter circuits.

15 Claims, 3 Drawing Sheets

STAGGERING SWITCHING SIGNALS FOR MULTIPLE COLD CATHODE FLUORESCENT LAMP BACKLIGHTING SYSTEM TO REDUCE ELECTROMAGNETIC INTERFERENCE

CROSS-REFERENCE TO RELATED APPLICATION

The present application claims the benefit of co-pending patent application Ser. No. 60/565,955, filed Apr. 28, 2004, by R. Lyle et al, entitled: "Staggered FET Drive in Multi Lamp LCD Backlight Inverter Systems," assigned to the assignee of the present application and the disclosure of which is incorporated herein.

FIELD OF THE INVENTION

The present invention relates in general to power supply systems and subsystems thereof, and is particularly directed to a method and apparatus for reducing electromagnetic interference (EMI) in a power supply switching circuit of the type used to control the AC power being supplied to a multiple high voltage devices, such as cold cathode fluorescent lamps (CCFLs) employed for backlighting a large scale liquid crystal display (LCD).

BACKGROUND OF THE INVENTION

There are a variety of electrically driven systems that require one or multiple sources of high voltage AC power for controlling the operation of one or more system application devices. As a non-limiting example, a liquid crystal display (LCD), such as that employed in desktop and laptop computers, or in larger display applications, such as large scale television screens, requires that an associated set of high AC voltage-driven cold cathode fluorescent lamps (CCFLs) be mounted directly behind it for backlighting purposes. Where the LCD panel is a large scale display device, a relatively large number (e.g., on the order of twenty to forty) of such lamps is required to achieve uniform backlighting.

In order to obtain a uniform brightness output from all such lamps (and therefore uniform backlighting of the LCD display), it is common practice to have the output of a respective one of a plurality of inverter circuits (voltage-controlled switching devices and associated output transformers coupled to the lamps) coupled to a prescribed number of (e.g., on the order of four to five) CCFLs, and drive each inverter circuit by way of a common high frequency switching signal (such as a 50 KHz signal). Unfortunately, as the number of inverter circuits is increased (in association with larger area CCFL backlighting requirements), the larger is electromagnetic interference (EMI) produced by driving multiple inverter circuits with the same switching signal. Indeed, for relatively large power switching systems, the magnitude of the EMI may be so large as to make the system non-compliant with FCC specifications.

SUMMARY OF THE INVENTION

In accordance with the present invention, this EMI problem is successfully addressed by slightly staggering, or offsetting in time, the switching signals with which respective ones of multiple sets of power switching inverters are driven. By 'slightly' offset is meant that the time differential between any pair of switching signals (which are referenced to a common switching frequency) is relatively small (e.g., by an order of magnitude) compared to the period of the switching signal frequency. This has the effect of spreading out and thereby diminishing the magnitude of the spectral content of both capacitively coupled and inductively coupled transients that are produced at switching times of the inverters.

For this purpose, the front end of a staggered switching signals-based, DC-AC power supply circuit architecture in accordance with the invention comprises a clock offset and distribution circuit, which is driven by a high frequency clock signal having a frequency considerably higher than the clock rate used to energize the CCFLs of multiple banks of CCFLs. As a non-limiting example, the reference clock input to the clock offset and distribution circuit may have a frequency on the order 800 KHz, which has a period that is only one-eighth of the period of a typical 50 KHz inverter switching signal. This relatively smaller period of the 800 KHz input clock is used to 'slightly' offset in time, or 'stagger', respective ones of a plurality of 50 KHz switching signals through which separate CCFL-controlling inverter circuits are switched.

A circuit to generate the offset or staggered clocks may be readily implemented with a counter, demultiplexer, t-flip-flops (if square wave outputs are desired) and an input clock signal operating at 2 times N times the desired switching frequency (2*N*Fsw). The input clock is coupled to the input of the counter. The output of the counter is coupled to the input of a demultiplexer (also known as a 'one of N demultiplexer' because an input of m bits sets one of 2^m outputs active and all others inactive). Each pulse of the input clock increments the output of the counter and changes the active output of the demultiplexer to the next 'one of N'. The N outputs of the demultiplexer may be coupled to Toggle flip-flops to convert the narrow pulses from the demultiplexer to square waves. For example, an 800 KHz clock, input to a 4 bit binary counter produces a 4 bit binary number that increments every 1.25 usec. Coupling the 3 least significant bits to a 1 of 8 demultiplexer produces 8 outputs that are active in sequence for 1.25 usec every 10 usec. In other words, demultiplexer output number one is active for 1.25 usec followed by output number 2, then number 3 and so on until number 8 which is followed by number one and the process repeats. Coupling each of these 8 outputs to a toggle flip-flop produces 8 square waves with 20 usec periods (50 KHz) staggered in time by 1.25 usec. Although a means of generating 8 staggered clock signals is described here, the number of channels is only constrained by the input clock frequency and the number of bits in the counter and the demultiplexer. In subsequent descriptions will refer to a 3 channel system for simplicity.

The outputs of the flip-flops provide sequentially offset square wave signals to control logic circuits within respective ones of a plurality (three in the example) of CCFL bank driver units. The control logic circuits use the low-to-high and high-to-low transitions in the FSW signals to generate sets of upper and lower gate switching signals for controlling the turn on times of upper and lower switching MOSFETs of each CCFL bank driver unit. The upper switching MOSFET has its source-drain current flow path coupled between a first end of a primary winding of a step-up transformer and a resistor referenced to ground. The primary winding of the step up transformer has its center tap coupled to a prescribed DC power supply voltage. The lower MOSFET switch has its source-drain current flow path coupled between a second end of the primary winding and a resistor referenced to ground. These two ground-referenced resistors are used to develop respective voltages proportional to the currents in the source-drain paths of the MOSFET switches. These MOSFET-current representative voltages are fed back to error signal processing circuitry which is operative to control one or more operational parameters of the DC-AC power supply in accordance with these and other monitored inputs, as desired.

The step-up transformer has a secondary winding, one end of which is coupled through a diode to a resistor referenced to ground, and the other end of which is coupled through a capacitor and an inductor to near end terminals of a plurality or 'bank' of cold cathode fluorescent lamps, far end terminals of which are grounded. An output capacitor referenced to ground is also coupled to near end terminals of the bank of CCFLs. An LC tank circuit tuned to the 50 KHz frequency of the stagger switching signals is formed by the inductance of the transformer and the capacitance of associated coupling and output capacitors. This tank circuit serves to effectively convert the high frequency square wave outputs of the MOSFET switches into a sine wave having substantially suppressed harmonic components.

In operation, the high frequency clock signal is divided down by the counter by a divisor associated with the intended time offsets between respective inverter switching signals. In the example of using a 800 KHz clock signal, the counter divides the clock signal by a factor of eight and provides three, 100 KHz signals to the demultiplexer. The demultiplexer, in turn, demultiplexes these three clocks signals, respectively offset from one another by the period (1.25 microsec.) of the 800 Khz clock signal. These three time-'staggered' signals are coupled to a set of toggle flip-flops, to produce three sequentially offset square FSW waveforms.

For the divide by eight operation of the counter, a first of these FSW waveforms (FSW1) undergoes a low-to-high transition at an arbitrary time t0 and a high-to-low transition at subsequent time t8. The low-to-high transitions of the FSW1 waveform are used by control logic within the CCFL bank driver unit to produce an upper gate drive signal for turning on the gate drive to the upper MOSFET switch at time t0, while the high-to-low transitions of the FSW waveform FSW1 are used by the control logic to produce a lower gate drive signal that is used to turn on the gate drive to the lower MOSFET switch at time t8. These two gate drive signals undergo high-to-low transitions at times in accordance with each CCFL bank driver's control loop. When turned on by their associated gate drive waveforms, upper and lower MOSFET switching devices provide current flow paths therethrough to ground for opposite ends of the center-tapped primary winding of the step-up transformer. The voltage induced in the stepped up secondary winding is applied to the multiple CCFLs within the CCFL bank thereby illuminating an adjacent portion of a backlit LCD.

The next waveform (FSW2), which is offset or delayed in time relative to the first waveform (FSW1), has a low-to-high transition at time t1 (where t1−t0=1.25 microseconds), and a high-to-low transition at time t9. (wherein t9−t8=1.25 microseconds). The low-to-high transitions of waveform FSW2 are used by the control logic within its CCFL bank driver unit to produce the upper gate drive signal for turning on the gate drive to the upper MOSFET switch within the CCFL bank driver unit at time t1, while the high-to-low transitions of waveform FSW2 are used by the control logic of the driver unit to produce the lower gate drive signal that is used to turn on the gate drive to the lower MOSFET switch within the CCFL bank driver unit at time t9. As with the firs CCFL bank driver unit, when turned on by their associated gate drive waveforms in accordance with the FSW2 waveform, the upper and lower MOSFET switching devices within the second CCFL bank driver unit provide current flow paths to ground for opposite ends of the center-tapped primary winding of their associated transformer. The induced voltage in the stepped up secondary winding is applied to the multiple CCFLs within the associated CCFL bank, thereby illuminating an adjacent portion of the backlit LCD.

For the three CCFL bank examples, the next FSW waveform (FSW3) has a low-to-high transition at time t2, and a high-to-low transition at time t10. These respective transition times of waveform FSW3 are offset from corresponding transition times in the waveform FSW2 by the (1.25 microsec.) delay provided by the demultiplexer. The low-to-high transitions of waveform FSW3 are used by the control logic within the associated CCFL bank driver unit to produce the upper gate drive signal for turning on the gate drive to the upper MOSFET switch within the CCFL bank driver unit at time t2; the high-to-low transitions of waveform FSW3 are used by the control logic of driver unit to produce the lower gate drive signal GATE that is used to turn on the gate drive to the lower MOSFET switch within the CCFL bank driver unit at time t10.

When turned on by their associated upper and lower gate drive waveforms, the upper and lower MOSFET switching devices within the CCFL bank driver unit provide current flow paths to ground for opposite ends of the center-tapped primary winding of their associated transformer. The induced voltage in the stepped up secondary winding is applied to the multiple CCFLs within the associated CCFL bank, thereby illuminating an adjacent portion of the backlit LCD.

DETAILED DESCRIPTION

Before detailing the time-offset switching signals-based CCFL power supply circuit architecture of the present invention, it should be observed that the invention resides primarily in a prescribed novel arrangement of conventional controlled power supply and digital switching circuits and components therefor. Consequently, the configuration of such circuits and components and the manner in which they may be interfaced with a powered utility device, such as a cold cathode fluorescent lamp, have, for the most part, been depicted by readily understandable schematic-block diagrams and associated timing and frequency diagrams, which show only those specific features that are pertinent to the present invention, so as not to obscure the disclosure with details which will be readily apparent to those skilled in the art having the benefit of the description herein. Thus, the diagrammatic illustrations are primarily intended to show the major components of the invention in a convenient functional grouping, whereby the present invention may be more readily understood.

Figure 1:
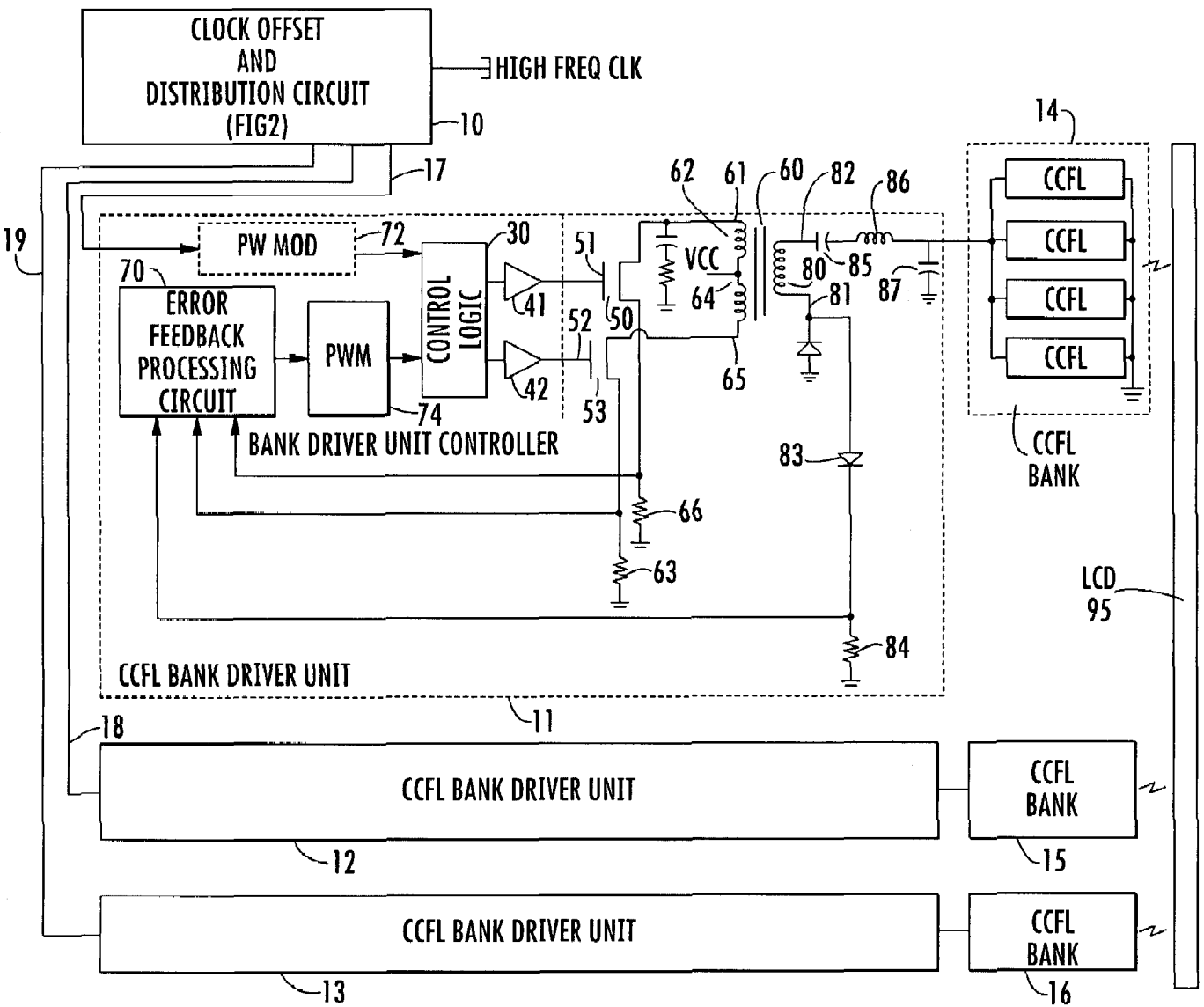
FIG. 1 is a diagrammatic illustration of a CCFL energization circuit architecture that produces and distributes time-offset versions of a high frequency switching signal for controlling the switching operation of multiple drive circuits used to supply AC power to a plurality of cold cathode fluorescent lamps in accordance with the invention.

Attention is now directed to FIG. 1, which is a schematic-block diagram of a non-limiting, but preferred embodiment of a staggered switching signals-based, DC-AC power supply circuit architecture in accordance with the invention. As shown therein, the front end of the DC-AC power supply includes a clock offset and distribution circuit 10 (to be detailed below with reference to FIG. 2). The clock offset and distribution circuit 10 is coupled to receive a relatively high frequency clock signal and to output therefrom a plurality of divided down clock signals (e.g., 50 KHz clock signals having a 50% duty cycle) that are slightly offset in time with respect to one another. These clock signals are applied to clock inputs of respective ones of a plurality of CCFL bank driver units 11, 12 and 13, outputs of which are coupled to associated banks of CCFLs 14, 15 and 16, that are used to backlight an adjacent LCD 95. While only three CCFL bank driver units 11, 12 and 13, and associated banks of CCFLs 14, 15 and 16 (containing four CCFLs per bank) are shown, it is to be understood that the invention is not limited to these or any other numbers. The parameters of the illustrated example have been selected to reduce the complexity of the drawings. To further reduce the complexity of the drawings the internal circuitry of only CCFL bank driver unit 11 and its associated CCFL bank have been shown in detail.

For purposes of providing a non-limiting example, the reference clock input to the clock offset and distribution circuit 10 may have a frequency on the order 800 KHz, which has a period that is one-eighth of the period of the 50 KHz inverter switching signal. This relatively smaller period of the 800 KHz input clock is used to 'slightly' offset in time, or 'stagger', respective ones of a plurality of 50 KHz switching signals through which separate CCFL-controlling inverter circuits are switched.

Figure 2:
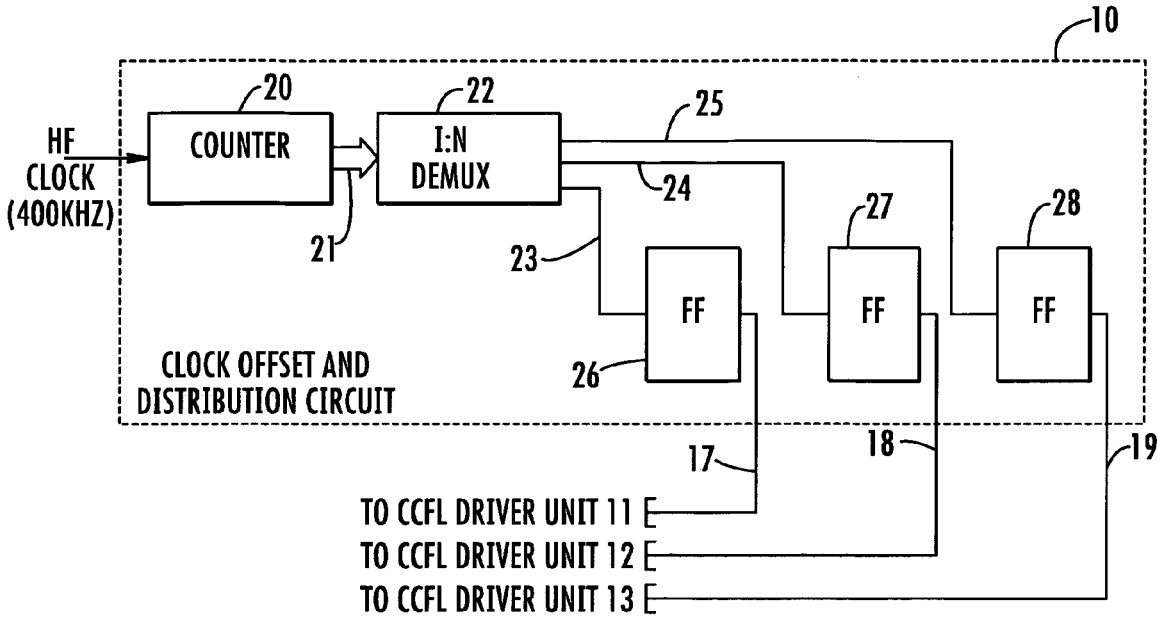
FIG. 2 shows an implementation of the clock offset and distribution circuit of the architecture of FIG. 1.

More particularly, with reference to FIG. 2, which shows a non-limiting implementation of the clock offset and distribution circuit 10, an original high frequency clock signal (e.g., having a clock frequency of 800 KHz is coupled to a counter 20, a set of binary-coded outputs 21 of which are coupled to a 1:N demultiplexer 22. Counter 20 is operative to divide the frequency of the high frequency clock signal by a prescribed divisor associated with the intended time offsets between respective ones of the inverter switching signals. For a 800 KHz clock signal, the counter may comprise a divide-by-eight counter, which is operative to provide a set of N 50 KHz clock signals that are respectively offset from one another by the period (1.25 microsec.) of the 800 Khz clock signal.

In accordance with the present example, letting N=3, demultiplexer 22 is operative to demultiplex or distribute, over respective outputs 23, 24 and 25, three 50 KHz clock signals that are offset in time relative to each other by the period of the high frequency (800 KHz) clock signal, or 1.25 microseconds between respectively demultiplexed 50 KHz clock signals. These three slightly time-offset or staggered 50 KHz clock signals are used to clock or toggle respective ones of a set of (N=3) toggled flip-flops 26, 27 and 28. More particularly, the QBAR outputs of the flip-flops, in turn, couple three respective FSW signals FSW1, FSW2 and FSW3 (depicted in the timing diagram of FIG. 3) over links 17, 18 and 19 to control logic circuits 30 within respective ones of the CCFL bank driver units 11, 12 and 13. As shown in the timing diagram of FIG. 3, these control logic circuits are operative to use the low-to-high and high-to-low transitions in the FSW signals to generate three respective sets of upper and lower gate switching signals: GATE 11, GATE 12 for controlling the turn on times of upper and lower switching MOSFETs of the first CCFL bank driver unit 11; GATE 21, GATE 22 for controlling the turn on times of upper and lower MOSFETs of the second CCFL bank driver unit 12; and GATE 31, GATE 32 for controlling the turn on times of upper and lower MOSFETs of the third CCFL bank driver unit 13. The turn off times of the switched MOSFETs are shown in broken lines and occur at the time determined by each CCFL bank driver's control loop. Each upper gate is turned on by a low-to-high transition in its GATE waveform that is coincident with rising edge of its associated FSW waveform, while each lower gate is turned on by a low-to-high transition in its GATE waveform that is coincident with falling edge of its associated FSW waveform.

Referring again to FIG. 1, the respective upper and lower 50 KHz gate drive signals GATE 11 and GATE 12 produced by control logic 30 are coupled to an associated pair of input driver amplifiers 41 and 42. The 50 KHz drive signal GATE 11 output by driver amplifier 41 is coupled to the gate input 51 of an upper MOSFET switch 50, while the 50 KHz drive signal GATE 12 output by driver amplifier 42 is coupled to the gate input 52 of a lower MOSFET switch 53. MOSFETs 50 and 53 are switched ON and OFF in a push-pull manner by the 50 KHz switching signal. Upper MOSFET switch 50 has its source-drain current flow path coupled between a first end 61 of a primary winding 62 of a step-up transformer 60 and a resistor 63 referenced to ground. Primary winding 62 has its center tap 64 coupled to a prescribed DC power supply voltage (e.g., 24 VDC). The lower MOSFET switch 53 has its source-drain current flow path coupled between a second end 65 of the primary winding 62 and a resistor 66 referenced to ground.

Figure 3:
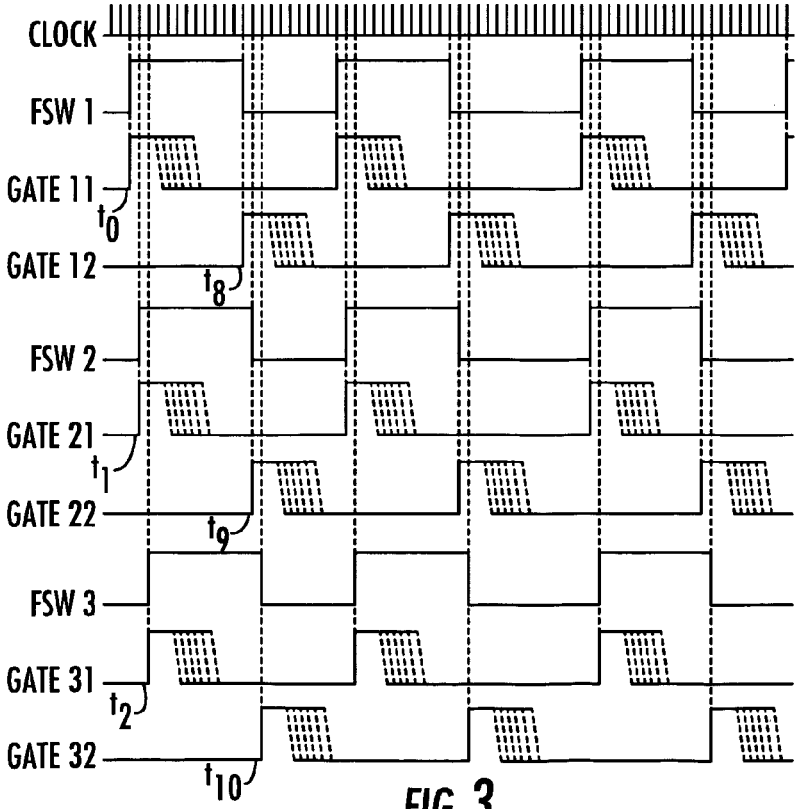
FIG. 3 is a timing diagram associated with the operation of the staggered switching signal-based CCFL power supply circuit architecture of FIG. 1.

Resistors 63 and 66 are used to develop respective voltages proportional to the currents in the source-drain paths of the MOSFET switches 50 and 53, to which the opposite ends 61 and 65 of the transformer's primary winding 60 are respectively coupled. These MOSFET-current representative voltages are fed back to error signal processing circuitry 70, which is operative to control one or more operational parameters of the DC-AC power supply in accordance with these and other monitored inputs, as desired. As a non-limiting example, this control circuit may be used to control the modulation of each of the respective 50 KHz switching signals, by means of a CCFL dimming signal, in the manner described in co-pending U.S. patent application Ser. No. 10/927,755 filed on Aug. 27, 2004, by R. Lyle et al, entitled: "Apparatus and Method of Employing Combined Switching and PWM Dimming Signals to Control Brightness of Cold Cathode Fluorescent Lamp Used to Backlight Liquid Crystal Display" (hereinafter referred to as the '755 application), assigned to the assignee of the present application and the disclosure of which is incorporated herein. Where CCFL dimming circuitry of the type described in the '755 application is employed, the error signal processing circuitry may be further used to control the operation of respective PWM modulator circuits, one of which is shown in broken lines 72 and is installed in link 17 of the CCFL bank driver unit 11. A PWM circuit 74, under the control of the error feedback processing circuitry 70, is used to control the rising and falling edges of the respective GATE 11 and GATE 12 signals applied to the gate 51 of upper MOSFET 50 and to the gate 52 of the lower MOSFET 53. As pointed out above, and as shown in FIG. 3, the rising edges of the switching signals GATE 11 and GATE 12 are respectively coincident with the rising edge and falling edge of the FSW1 signals supplied from the clock offset and distribution circuit over link 17. The falling edges or turn off times of the upper and lower MOSFETs occur at times determined by each CCFL bank driver's control loop.

Transformer 60 has a secondary winding 80, a first end 81 of which is coupled through a diode 83 to a resistor 84, referenced to ground, and a second end 82 of which is coupled through a capacitor 85 and an inductor 86 to near end terminals of a plurality or 'bank' of cold cathode fluorescent lamps 90, far end terminals of which are grounded. An output capacitor 87, referenced to ground, is coupled to near end terminals of the bank 14 of CCFLs 90. An LC tank circuit tuned to the 50 KHz switching signal is formed by the inductance of the transformer and the capacitance of associated coupling and output capacitors. This tank circuit serves to effectively convert the high frequency square wave outputs of the MOSFET switches 50 and 52 into a sine wave having very substantially suppressed harmonic components.

Operation of the staggered switching signals-based DC-AC power supply circuit architecture of FIG. 1 may be understood by reference to the timing diagram of FIG. 3. The high frequency clock signal is labelled CLOCK. As pointed out above, the counter 20 within the clock offset and distribution unit 10 divides the frequency of the high frequency clock signal CLOCK by a prescribed divisor associated with the intended time offsets between respective ones of the inverter switching signals. In the present example of using a 800 KHz clock signal, counter 20 divides the clock signal by a factor of eight and provides three 100 KHz signals to the demultiplexer 22. Demultiplexer 22, in turn, demultiplexes these three clocks signals, which are respectively offset from one another by the period (1.25 microsec.) of the 800 Khz clock signal, over its output lines 23, 24 and 25 to respective toggled flip-flops 26, 27 and 28, so as to produce the three waveforms FSW1, FSW2 and FSW3 (each having a 50% duty cycle).

In FIG. 3, waveform FSW1 is shown as having a low-to-high transition at a time t0 and a high-to-low transition at time t8. The low-to-high transitions of waveform FSW1 are used by the control logic 30 within the CCFL bank driver unit 11 to produce the upper gate drive signal GATE 11 for turning on the gate drive to the upper MOSFET switch 50 (via its associated driver 41) at time t0, while the high-to-low transitions of waveform FSW1 are used by the control logic 30 to produce the lower gate drive signal GATE 12 that is used to turn on the gate drive to the lower MOSFET switch 50 (via its associated driver 42) at time t8.

As pointed out above, these two gate drive signals GATE 11 and GATE 12 undergo high-to-low transitions at times (shown in broken lines in FIG. 3) determined by each CCFL bank driver's control loop. When turned on by their associated GATE 11 and GATE 12 waveforms, MOSFET switching devices 50 and 53 provide current flow paths therethrough to ground (via respective resistors 63 and 66) for opposite ends of the center-tapped primary winding 62 of the transformer 60. The induced voltage in the stepped up secondary winding is applied to the multiple CCFLs 90 within the CCFL bank 14, thereby illuminating an adjacent portion of backlit LCD 95.

The next waveform FSW2 is shown in FIG. 3 as having a low-to-high transition at time t1, and a high-to-low transition at time t9. These respective transition times of waveform FSW2 are offset from corresponding transition times in the waveform FSW1 by the (1.25 microsec.) delay associated with output 24 of demultiplexer 22. The low-to-high transitions of waveform FSW2 are used by the control logic within the CCFL bank driver unit 12 to produce the upper gate drive signal GATE 21 for turning on the gate drive to the upper MOSFET switch within the CCFL bank driver unit 12 at time t1, while the high-to-low transitions of waveform FSW2 are used by the control logic of driver unit 12 to produce the lower gate drive signal GATE 22 that is used to turn on the gate drive to the lower MOSFET switch within the CCFL bank driver unit 12 at time t9.

As pointed out above the two gate drive signals GATE 21 and GATE 22 undergo high-to-low transitions at times (shown in broken lines in FIG. 3) determined by each CCFL bank driver's control loop. When turned on by their associated GATE 21 and GATE 22 waveforms, the upper and lower MOSFET switching devices within the CCFL bank driver unit 12 provide current flow paths to ground for opposite ends of the center-tapped primary winding of their associated transformer. The induced voltage in the stepped up secondary winding is applied to the multiple CCFLs 90 within the CCFL bank 15, thereby illuminating an adjacent portion of the backlit LCD 95.

The next waveform FSW3 is shown in FIG. 3 as having a low-to-high transition at time t2, and a high-to-low transition at time t10. These respective transition times of waveform FSW3 are offset from corresponding transition times in the waveform FSW2 by the (1.25 microsec.) delay associated with output 25 of demultiplexer 22. The low-to-high transitions of waveform FSW3 are used by the control logic within the CCFL bank driver unit 13 to produce the upper gate drive signal GATE 31 for turning on the gate drive to the upper MOSFET switch within the CCFL bank driver unit 13 at time t2, while the high-to-low transitions of waveform FSW3 are used by the control logic of driver unit 13 to produce the lower gate drive signal GATE 32 that is used to turn on the gate drive to the lower MOSFET switch within the CCFL bank driver unit 13 at time t10.

The two gate drive signals GATE 31 and GATE 32 undergo high-to-low transitions at times (shown in broken lines in FIG. 3) determined by each CCFL bank driver's control loop. When turned on by their associated GATE 31 and GATE 32 waveforms, the upper and lower MOSFET switching devices within the CCFL bank driver unit 13 provide current flow paths to ground for opposite ends of the center-tapped primary winding of their associated transformer. The induced voltage in the stepped up secondary winding is applied to the multiple CCFLs 90 within the CCFL bank 16, thereby illuminating an adjacent portion of backlit LCD 95.

Figure 4:
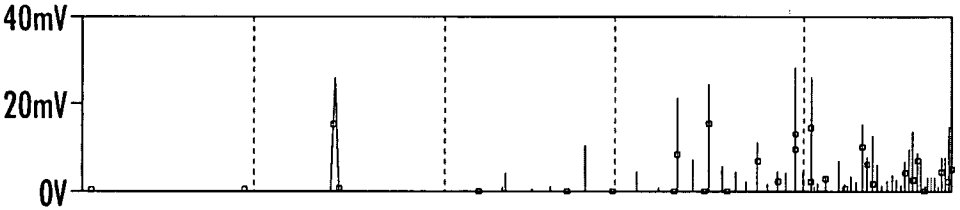
FIGS. 4 and 5 are spectral diagrams which respectively show capacitively coupled and inductively coupled EMI produced by the staggered switching signal-based power supply circuit architecture of FIG. 1.
Figure 5:
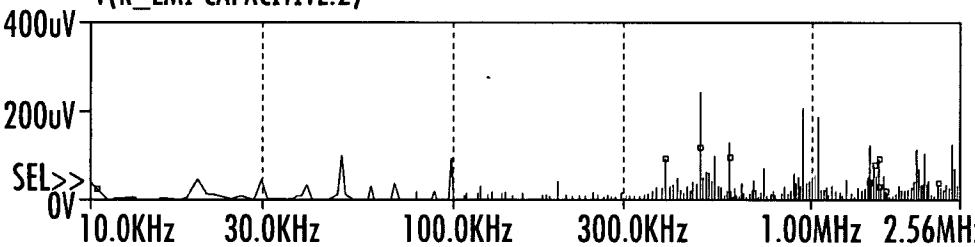
Figure 6:
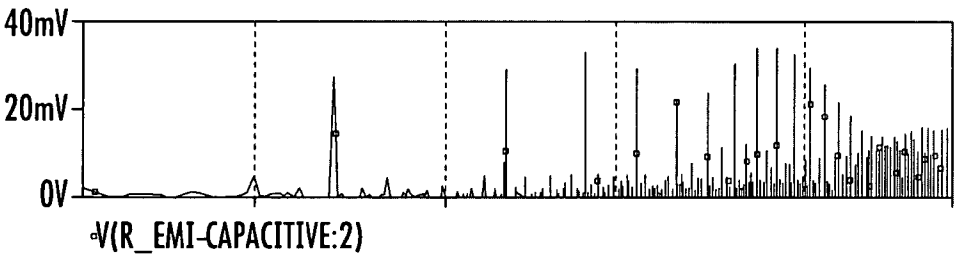
FIGS. 6 and 7 are spectral diagrams which respectively show capacitively coupled and inductively coupled EMI produced by a three CCFL bank driver unit circuit topology simultaneously driven by the same clock source and not employing the staggered or distributed clock signal circuitry in accordance with the present invention.
Figure 7:
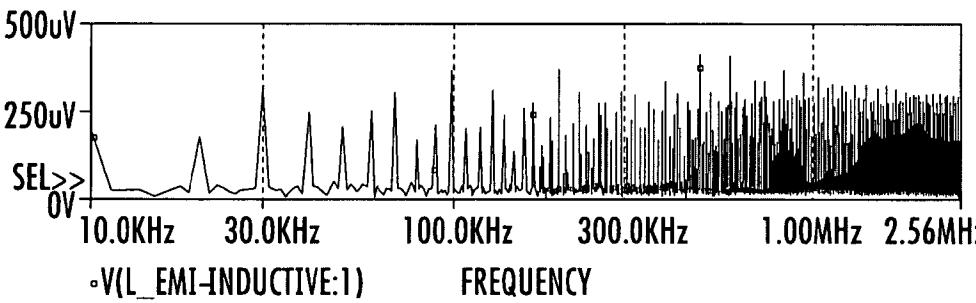

Simulation performance measurements were carried out on both a three CCFL bank driver unit circuit topology employing the staggered or distributed clock signal circuitry in accordance with the present invention, described above, and on a three CCFL bank driver unit circuit topology, where each driver unit was driven by the same clock source, that did not involve the used of staggered clocking. FIG. 4 is a spectral plot of capacitively coupled EMI, and FIG. 5 is a spectral plot of inductively coupled EMI for a three CCFL bank driver unit circuit topology employing the staggered or distributed clock signal circuitry in accordance with the present invention, whereas FIG. 6 is a spectral plot of capacitively coupled EMI, and FIG. 7 is a spectral plot of inductively coupled EMI for a three CCFL bank driver unit circuit topology driven by the same clock source and not employing the staggered or distributed clock signal circuitry in accordance with the present invention.

A comparison of these two plots of performance data readily reveals that the present invention enjoys substantially reduced and suppressed EMI relative to that of a conventional simultaneous clocking scheme. Parametric measurements have further revealed that the maximum RMS value of capacitively coupled noise produced when using the staggered clocking technique in accordance with the present invention is on the order of only one-third the maximum RMS value of capacitively coupled noise produced using conventional simultaneous clocking.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art. For example, although the inverter switches are shown as MOSFET devices, it is to understood that other equivalent circuit components, such as bipolar transistors, IGFETs, or other voltage controlled switching devices, may be used. Moreover although push-pull inverter switching circuitry is shown, other configurations, such as, but not limited to half-bridge and full-bridge topologies, may be employed.

What is claimed is:

1. An apparatus for supplying AC power at a prescribed AC frequency to respective ones of a plurality of high voltage devices comprising:

a plurality of switched power supply units having outputs thereof respectively coupled to said plurality of high voltage devices, a respective power supply unit having switching devices that are controllably switched on and off at said prescribed AC frequency by respective switching signals applied thereto, said respective switching signals having said prescribed AC frequency, so as to apply respective AC power supply voltages having said prescribed AC frequency to said respective ones of said plurality of high voltage devices; and a switching signal generator, which is operative to provide said respective switching signals having said prescribed AC frequency and offset in time with respect to one another by respective fractions of the period of said prescribed AC frequency, such that no two of said plurality of switched power supply units have switching devices thereof switched on and off at the same time, whereby said respective AC power supply voltages that are applied to said respective ones of said plurality of high voltage devices are offset in time with respect to one another.

2. The apparatus according to claim 1, wherein said prescribed AC frequency is 50 KHz, so that said respective ones of said plurality of high voltage devices are supplied with respective 50 KHz AC power supply voltages that are offset in time with respect to one another by respective fractions of the period of said 50 KHz frequency.

3. The apparatus according to claim 1, wherein a respective one of said plurality of switched power supply units comprises:

a first switching circuit having a first switching device coupled to a first portion of a primary winding of a transformer, said transformer having a secondary winding coupled to a respective one of said plurality of high voltage devices, said first switching device, when turned on by first transitions in a respective one of said plurality of switching signals, being operative to controllably switch a first current through said primary winding of said transformer at said prescribed AC frequency; and a second switching circuit having a second switching device coupled to a second portion of said primary winding of said transformer, said second switching device, when turned on by second transitions in said respective one of said plurality of switching signals, being operative to controllably switch a second current through said primary winding of said transformer at said prescribed AC frequency.

4. The apparatus according to claim 1, wherein said high voltage devices comprise cold cathode fluorescent lamps.

5. The apparatus according to claim 1, wherein said switching signal generator is operative to divide down a high frequency waveform having a predetermined AC frequency that is higher than said prescribed AC frequency, and thereby provide said respective switching signals having said prescribed AC frequency and offset in time with respect to one another by said respective fractions of the period of said prescribed AC frequency.

6. A method for supplying AC power at a prescribed AC frequency to respective ones of a plurality of high voltage devices comprising the steps of:

(a) generating a plurality of switching signals that have said prescribed AC frequency and are offset in time with respect to one another by respective fractions of the period of said prescribed AC frequency;

(b) turning switching devices of respective ones of a plurality of switched power supply units, that have outputs thereof respectively coupled to said plurality of high voltage devices, on and off at said prescribed AC frequency by respective ones of said plurality of switching signals generated in step (a), so that no two of said plurality of switched power supply units have switching devices thereof turned on and off at the same time, and thereby apply respective AC power supply voltages having said prescribed AC frequency and being offset in time with respect to one another to said respective ones of said plurality of high voltage devices.

7. The method according to claim 6, wherein said prescribed AC frequency is 50 KHz, so that said respective ones of said plurality of high voltage devices are supplied with respective 50 KHz AC power supply voltages that are offset in time with respect to one another by respective fractions of the period of said 50 KHz frequency.

8. The method according to claim 6, wherein a respective one of said plurality of switched power supply units comprises:

a first switching circuit having a first switching device coupled to a first portion of a primary winding of a transformer, said transformer having a secondary winding coupled to a respective one of said plurality of high voltage devices, said first switching device, when turned on by first transitions in a respective one of said plurality of switching signals, being operative to controllably switch a first current through said primary winding of said transformer at said prescribed AC frequency; and a second switching circuit having a second switching device coupled to a second portion of said primary winding of said transformer, said second switching device, when turned on by second transitions in said respective one of said plurality of switching signals, being operative to controllably switch a second current through said primary winding of said transformer at said prescribed AC frequency.

9. The method according to claim 6, wherein said high voltage devices comprise cold cathode fluorescent lamps.

10. The method according to claim 6, wherein step (a) comprises dividing down a high frequency waveform having a predetermined AC frequency that is higher than said prescribed AC frequency, and thereby provide said respective switching signals having said prescribed AC frequency and offset in time with respect to one another by said respective fractions of the period of said prescribed AC frequency.

11. In a method for supplying AC power at a prescribed AC frequency to respective ones of a plurality of high voltage devices by turning switching devices of respective ones of a plurality of switched power supply units, that have outputs thereof respectively coupled to said plurality of high voltage devices, on and off at said prescribed AC frequency by respective ones of a plurality of switching signals having said prescribed AC frequency, the improvement comprising the step of:

offsetting respective ones of said plurality of switching signals in time with respect to one another by respective fractions of the period of said prescribed AC frequency, so that no two of said plurality of switched power supply units have switching devices thereof turned on and off at the same time, and thereby causing said respective ones of said plurality of switched power supply units to apply respective AC power supply voltages having said prescribed AC frequency and offset in time with respect to one another to said respective ones of said plurality of high voltage devices.

12. The improvement according to claim 11, wherein said prescribed AC frequency is 50 KHz, so that said respective ones of said plurality of high voltage devices are supplied with respective 50 KHz AC power supply voltages that are offset in time with respect to one another by respective fractions of the period of said 50 KHz frequency.

13. The improvement according to claim 11, wherein a respective one of said plurality of switched power supply units comprises:

a first switching circuit having a first switching device coupled to a first portion of a primary winding of a transformer, said transformer having a secondary winding coupled to a respective one of said plurality of high voltage devices, said first switching device, when turned on by first transitions in a respective one of said plurality of switching signals, being operative to controllably switch a first current through said primary winding of said transformer at said prescribed AC frequency; and a second switching circuit having a second switching device coupled to a second portion of said primary winding of said transformer, said second switching device, when turned on by second transitions in said respective one of said plurality of switching signals, being operative to controllably switch a second current through said primary winding of said transformer at said prescribed AC frequency.

14. The improvement according to claim 11, wherein said high voltage devices comprise cold cathode fluorescent lamps.

15. The improvement according to claim 11, wherein said offsetting step comprises dividing down a high frequency waveform having a predetermined AC frequency that is higher than said prescribed AC frequency, and thereby providing said respective switching signals having said prescribed AC frequency and offset in time with respect to one another by said respective fractions of the period of said prescribed AC frequency.

* * * * *